US007374112B1

(12) United States Patent
Bulan et al.

(10) Patent No.: US 7,374,112 B1
(45) Date of Patent: May 20, 2008

(54) INTERLEAVED MULTI-FUNCTION SHOWERHEAD

(75) Inventors: Jamy Bulan, Lakewood, OH (US); James F. Dempsey, North Olmsted, OH (US); Timothy John O'Brien, Shaker Heights, OH (US); Harshil Parikh, North Olmsted, OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 11/788,332

(22) Filed: Apr. 19, 2007

(51) Int. Cl.
*B05B 1/14* (2006.01)

(52) U.S. Cl. ..... 239/556; 239/436; 239/548; 239/558; 239/563

(58) Field of Classification Search ..... 239/556, 239/436, 548, 558, 563, 390–397, 442–444, 239/447, 536, 557, 567, 559–562, 17
See application file for complete search history.

(56) References Cited

U.S. PATENT DOCUMENTS

| | | | | |
|---|---|---|---|---|
| 1,958,038 | A | 5/1934 | Fraser | |
| 2,024,510 | A | 12/1935 | Crisenberry | |
| 3,008,652 | A | 11/1961 | McLean | |
| 3,998,390 | A * | 12/1976 | Peterson et al. | 239/394 |
| 4,302,040 | A | 11/1981 | Lazar | |
| 4,413,362 | A | 11/1983 | Chianco et al. | |
| D349,947 | S | 8/1994 | Hing-Wah | |
| D374,273 | S | 10/1996 | Chan | |
| D379,212 | S | 5/1997 | Chan | |
| D385,616 | S | 10/1997 | Dow et al. | |
| D392,369 | S | 3/1998 | Chan | |
| D394,897 | S | 6/1998 | Chan | |
| D415,821 | S | 10/1999 | Milrud et al. | |
| D417,257 | S | 11/1999 | Milrud | |
| D424,164 | S | 5/2000 | Haug et al. | |
| D429,795 | S | 8/2000 | Tse | |
| D430,265 | S | 8/2000 | Tse | |
| D432,211 | S | 10/2000 | Chan | |
| D432,625 | S | 10/2000 | Chan | |
| D439,305 | S | 3/2001 | Slothower | |
| D440,276 | S | 4/2001 | Slothower | |
| D440,277 | S | 4/2001 | Slothower | |
| D440,278 | S | 4/2001 | Slothower | |
| D443,026 | S | 5/2001 | Kollmann et al. | |
| 6,230,989 | B1 | 5/2001 | Haverstraw et al. | |
| D450,372 | S | 11/2001 | Christianson | |
| D451,170 | S | 11/2001 | Lindholm et al. | |
| D452,897 | S | 1/2002 | Gillette et al. | |
| D457,937 | S | 5/2002 | Lindholm et al. | |
| D459,437 | S | 6/2002 | Christianson | |
| 6,412,125 | B1 | 7/2002 | Ito et al. | |
| 6,454,186 | B2 | 9/2002 | Haverstraw et al. | |
| 6,550,697 | B2 * | 4/2003 | Lai | 239/446 |
| D477,652 | S | 7/2003 | Itoh | |
| 6,641,057 | B2 | 11/2003 | Thomas et al. | |

(Continued)

*Primary Examiner*—Darren Gorman
(74) *Attorney, Agent, or Firm*—Calfee, Halter & Griswold LLP

(57) ABSTRACT

A multi-function showerhead has at least a first set of nozzles forming first curves and a second set of nozzles forming second curves. The showerhead discharges water through the first curves when a first water delivery function is selected and through the second curves when a second water delivery function is selected. The first curves and the second curves are interleaved so that a coherent and balanced spray pattern is provided resulting in a pleasant showering experience, regardless of the selected water delivery function.

22 Claims, 14 Drawing Sheets

U.S. PATENT DOCUMENTS

| | | | | |
|---|---|---|---|---|
| D483,838 | S | 12/2003 | Haug et al. | |
| 6,659,372 | B2 * | 12/2003 | Marsh et al. | 239/560 |
| D485,887 | S | 1/2004 | Luettgen et al. | |
| D487,301 | S | 3/2004 | Haug et al. | |
| D489,793 | S | 5/2004 | Haug et al. | |
| 6,736,336 | B2 | 5/2004 | Wong | |
| 6,739,523 | B2 | 5/2004 | Haverstraw et al. | |
| D495,027 | S | 8/2004 | Mazzola | |
| 6,796,518 | B2 * | 9/2004 | Douglas et al. | 239/587.4 |
| D498,514 | S | 11/2004 | Haug et al. | |
| D510,610 | S | 10/2005 | Bailey et al. | |
| 7,048,210 | B2 * | 5/2006 | Clark | 239/548 |
| 2002/0113145 | A1 * | 8/2002 | Wong | 239/446 |
| 2002/0116758 | A1 | 8/2002 | Ito | |
| 2002/0124307 | A1 | 9/2002 | McGill | |
| 2003/0204904 | A1 | 11/2003 | Ito | |
| 2005/0001072 | A1 | 1/2005 | Bolus et al. | |
| 2005/0061896 | A1 | 3/2005 | Luettgen et al. | |
| 2005/0284967 | A1 * | 12/2005 | Korb et al. | 239/552 |
| 2006/0102747 | A1 * | 5/2006 | Ho | 239/383 |

* cited by examiner

INTERLEAVED MULTI-FUNCTION SHOWERHEAD

FIELD

The invention relates generally to showerheads and, more particularly, to multi-function showerheads.

BACKGROUND

Multi-function showerheads are known in which different sets of nozzles provide different water delivery functions, such that a user can select between the different water delivery functions. Water is discharged from the multi-function showerhead differently for each of the water delivery functions so that the user experiences a desired sensation corresponding to the selected water delivery function. The water delivery functions can include, for example, a stream function, a spray function, a pulse function, and variations thereof. Furthermore, additional water delivery functions can be provided by using two or more sets of nozzles simultaneously.

Typically, each set of nozzles of a multi-function showerhead occupies a discrete zone or region (hereinafter "zone/region") on a face of the showerhead. For example, as shown in FIG. 1, a conventional multi-function showerhead is illustrated as a three-function showerhead 100 having a face 102 on which are arranged two distinct sets of nozzles, i.e., inner nozzles 104 and outer nozzles 106. For purposes of illustration, only a few of the nozzles 104 and 106 are labeled in the drawings. The inner nozzles 104 correspond to a first water delivery function and the outer nozzles 106 correspond to a second water delivery function. A third water delivery function is provided by discharging water through the inner nozzles 104 and the outer nozzles 106 simultaneously.

As shown in FIG. 2, the inner nozzles 104 occupy a substantially concentric zone/region 108 on the face 102. The outer nozzles 106 also occupy a substantially concentric zone/region 110 on the face 102. The zones/regions 108 and 110 are discrete areas on the face 102. The face 102 also includes dead zones 118 and 120. A "dead zone" is a space around, between or near the zones/regions that does not have nozzles and, thus, is incapable of discharging water regardless of the selected water delivery function.

The use of discrete zones/regions facilitates providing the underlying waterways corresponding to each set of the nozzles 104 and 106. As shown in FIG. 3, a first waterway 112 connects the inner nozzles 104 to an inlet port 114 of the showerhead 100. Likewise, a pair of second waterways 116 connect the outer nozzles 106 to the inlet port 114. The inlet port 114 can be connected to a water supply source (not shown) for delivering water to the showerhead 100.

A problem with using the discrete zones/regions, however, is that they give rise to the aforementioned dead zones 118 and 120. The dead zones 118 and 120 can result in poor water coverage (e.g., an incoherent and unbalanced spray pattern) with respect to a user's body that results in the user experiencing an unpleasant sensation when the water impacts his or her body. These problems of the dead zones 118 and 120 are exacerbated if a water delivery function is selected in which some nozzles on the showerhead are not used.

For example, with respect to the showerhead 100 of FIGS. 1-3, if the user selects the first water delivery function, water is discharged through the inner nozzles 104 only. Consequently, the dead zones 118 and 120, as well as the zone/region 110 containing the outer nozzles 106, on the face 102 are not used. As a result, the water is discharged from a small portion of the overall area of the face 102 and the user is likely to be dissatisfied with the corresponding small area of impact of the water on his or her body.

Additionally, if the user selects the second water delivery function, water is discharged through the outer nozzles 106 only. Consequently, the dead/zones 118 and 120, as well as the zone/region 108 containing the inner nozzles 104, on the face 102 are not used. As a result, the water is discharged from the face 102 with the dead zones noticeably affecting the feel of the water on the user's body. Here, the user can feel the circular spray pattern produced by the outer nozzles 106 but a large "hole" is also felt within the spray pattern because of the non-used dead/zones 118 and 120 and the non-used inner nozzles 104 in the zone/region 108.

Furthermore, if the user selects a third water delivery function, water is discharged through both the inner nozzles 104 and the outer nozzles 106 simultaneously. However, even in this case, the dead zones 118 and 120 result in an incoherent and unbalanced spray pattern providing less than ideal coverage and likely to have an unpleasant feel.

SUMMARY

In view of the above, a multi-function apparatus is provided that includes at least a first set of nozzles and a second set of nozzles. The apparatus discharges fluid according to a fluid delivery function selected from at least a first fluid delivery function, a second fluid delivery function and a third fluid delivery function. The first fluid delivery function corresponds to fluid being discharged through only the first set of nozzles, the second fluid delivery function corresponds to fluid being discharged through only the second set of nozzles and the third fluid delivery function corresponds to fluid being discharged through the first and second sets of nozzles simultaneously. The fluid delivery functions can be further differentiated by varying the number of nozzles, the size of the nozzles, the arrangement of the nozzles, and the like, in each of the sets of nozzles.

The first set of nozzles includes a plurality of first curves which are each formed, for example, from at least three adjacent nozzles in the first set of nozzles. Each first curve passes through a center of an opening in the at least three adjacent nozzles. The second set of nozzles includes a plurality of second curves which are each formed, for example, from at least three adjacent nozzles in the second set of nozzles. Each second curve passes through a center of an opening in the at least three adjacent nozzles.

As described herein, the first curves and the second curves are interleaved. Accordingly, the aforementioned problems associated with the dead zones (e.g., the incoherent and unbalanced spray patterns) are reduced, if not eliminated. As a result, the multi-function apparatus produces a coherent and balanced spray pattern regardless of the selected fluid delivery function.

Numerous additional advantages and features will become readily apparent from the following detailed description of exemplary embodiments, from the claims and from the accompanying drawings.

BRIEF DESCRIPTION OF THE DRAWINGS

The invention as well as embodiments and advantages thereof are described below in greater detail, by way of example, with reference to the drawings wherein like reference numbers denote like elements and in which.

DETAILED DESCRIPTION

Figure 1:
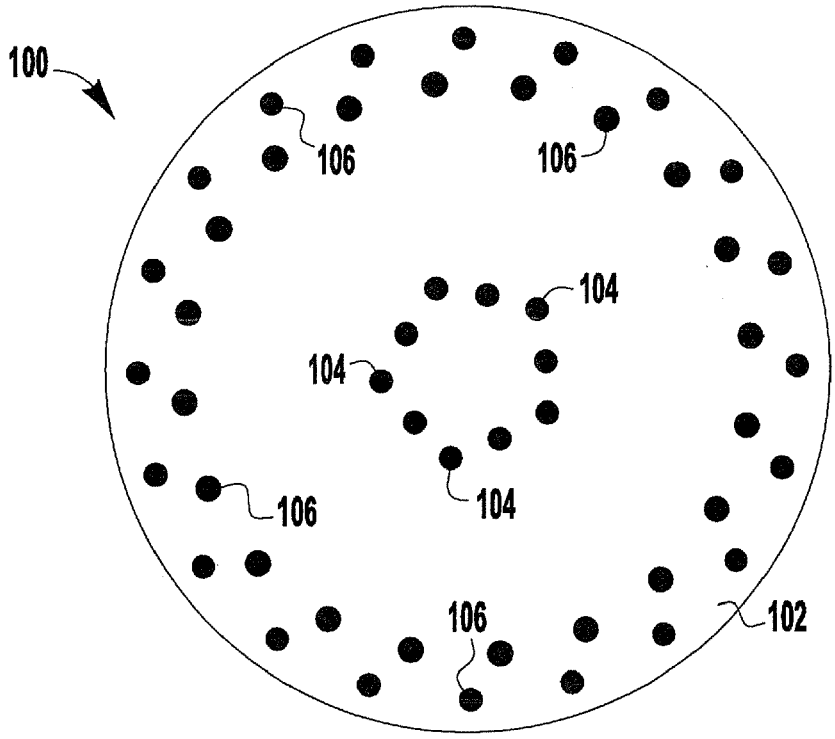
FIG. 1 PRIOR ART
FIG. 1 is a diagram of a face of a conventional multi-function showerhead having two distinct sets of nozzles.
Figure 2:
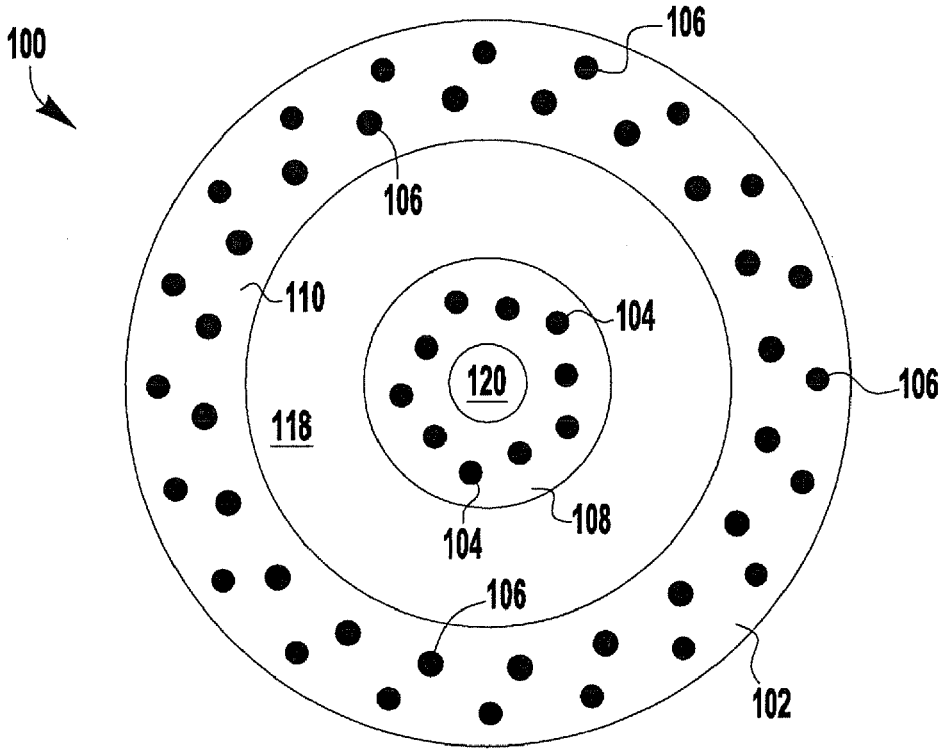
FIG. 2 PRIOR ART
FIG. 2 is a diagram of the face of the multi-function showerhead of FIG. 1 showing the discrete zones or regions of the sets of nozzles.
Figure 3:
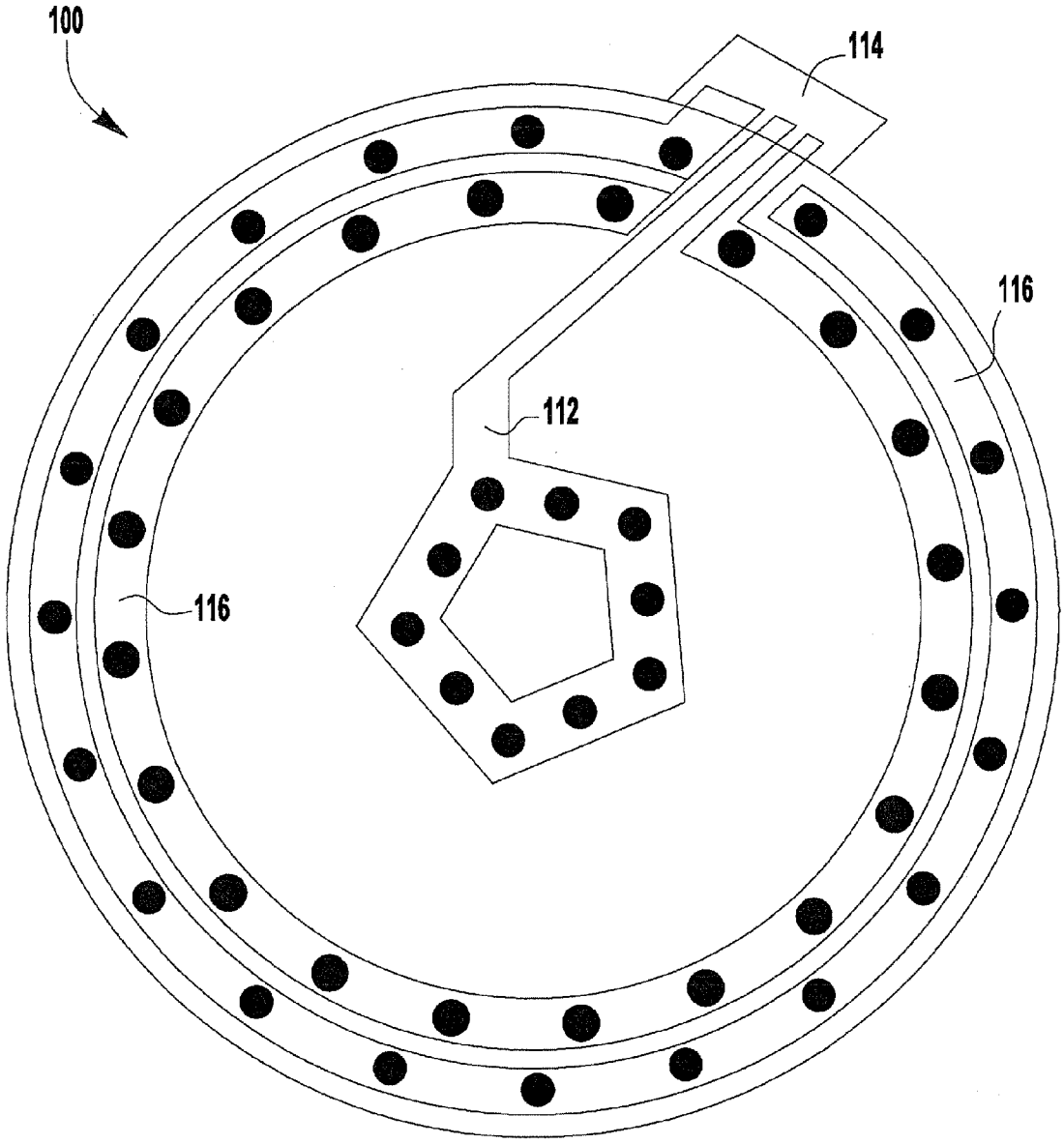
FIG. 3 PRIOR ART
FIG. 3 is a diagram of the multi-function showerhead of FIG. 1 showing the underlying waterways corresponding to the sets of nozzles.
Figure 4:
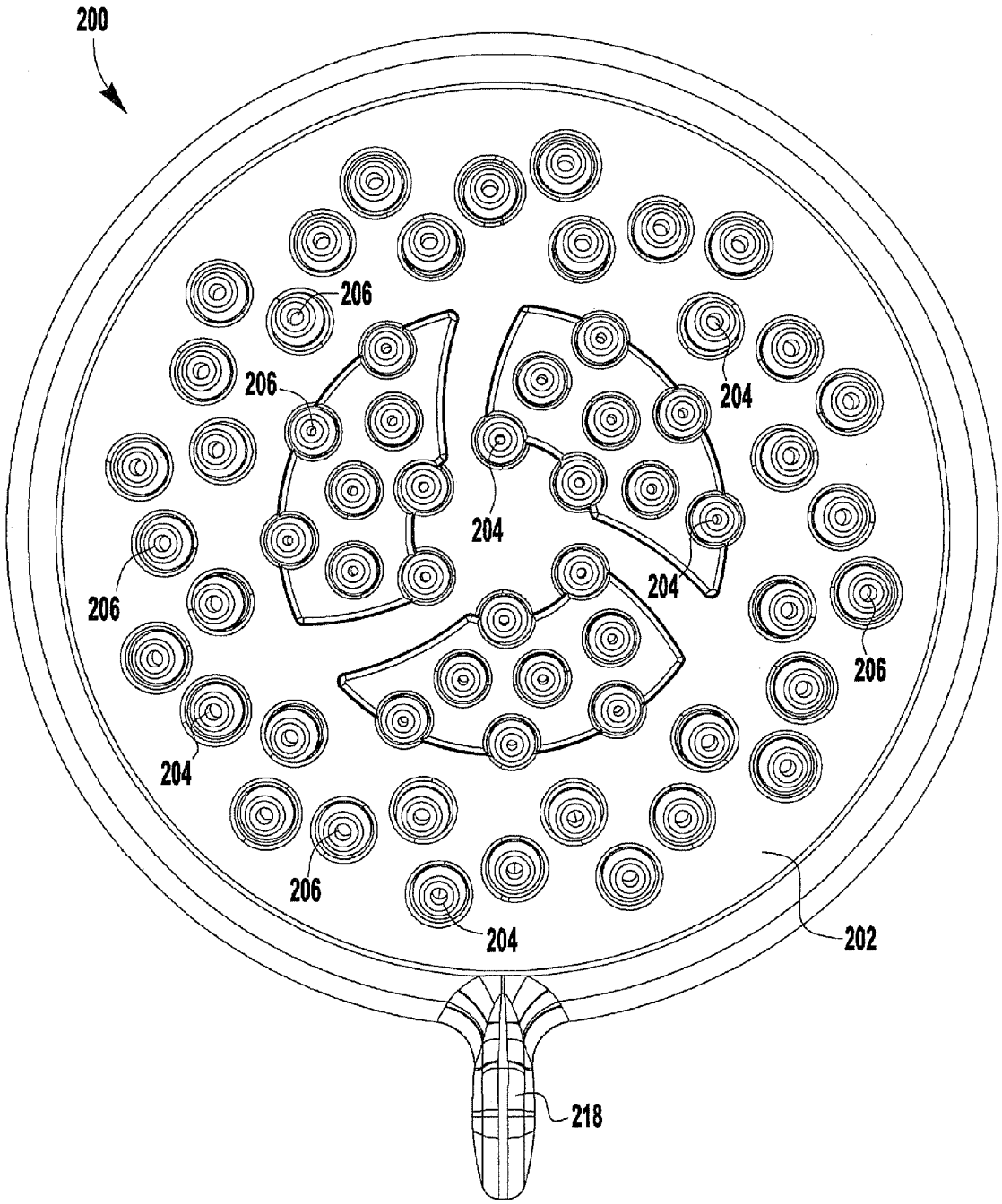
FIG. 4 is a diagram of a multi-function showerhead having two distinct sets of nozzles, according to an exemplary embodiment.

While the general inventive concept is susceptible of embodiment in many different forms, there are shown in the drawings and will be described herein in detail specific embodiments thereof with the understanding that the present disclosure is to be considered as an exemplification of the principles of the general inventive concept. Accordingly, the general inventive concept is not intended to be limited to the specific embodiments illustrated herein.

A multi-function showerhead according to an exemplary embodiment is shown as a three-function showerhead 200 (hereinafter, the "showerhead 200") in FIGS. 4-7. The showerhead 200 includes a face 202 in which a plurality of nozzles are disposed. The plurality of nozzles forms a first set of nozzles 204 and a second set of nozzles 206 on the face 202. For purposes of illustration, only a few of the nozzles 204, 206 are labeled in the drawings. In one exemplary embodiment, the nozzles 204, 206 extend through corresponding openings in the face 202.

The first set of nozzles 204 corresponds to a first water delivery function and the second set of nozzles 206 corresponds to a second water delivery function. A third water delivery function is provided by discharging water through the first set of nozzles 204 and the second set of nozzles 206 simultaneously. An actuator 218 is located, for example, on the showerhead 200 to allow a user to select among the different water delivery functions.

In one exemplary embodiment, the first set of nozzles 204 has at least 9 nozzles and the second set of nozzles 206 has at least 9 nozzles. As shown in FIGS. 4-7, the showerhead 200 has 36 nozzles in the first set of nozzles 204 and 24 nozzles in the second set of nozzles 206. The nozzles in the first set of nozzles 204 may or may not have the same dimensions. The nozzles in the second set of nozzles 206 may or may not have the same dimensions. The nozzles in both the first set of nozzles 204 and the second set of nozzles 206 may or may not have the same dimensions.

In one exemplary embodiment, a diameter of an opening in each nozzle in the first set of nozzles 204 is within 0.032 inches to 0.042 inches, inclusive. In another exemplary embodiment, a diameter of an opening in each nozzle in the first set of nozzles 204 is within 0.036 inches to 0.046 inches, inclusive. In yet another exemplary embodiment, a diameter of an opening in each nozzle in the first set of nozzles 204 is within 0.028 inches to 0.038 inches, inclusive. In still another exemplary embodiment, a diameter of an opening in each nozzle in the first set of nozzles 204 is within 0.030 inches to 0.040 inches, inclusive.

In one exemplary embodiment, a diameter of an opening in each nozzle in the first set of nozzles 204 is approximately equal to 0.034 inches. In another exemplary embodiment, a diameter of an opening in each nozzle in the first set of nozzles 204 is approximately equal to 0.042 inches. In yet another exemplary embodiment, a diameter of an opening in each nozzle in the first set of nozzles 204 is approximately equal to 0.030 inches. In still another exemplary embodiment, a diameter of an opening in each nozzle in the first set of nozzles 204 is approximately equal to 0.040 inches.

In one exemplary embodiment, a diameter of an opening in each nozzle in the second set of nozzles 206 is within 0.028 inches to 0.038 inches, inclusive. In another exemplary embodiment, a diameter of an opening in each nozzle in the second set of nozzles 206 is within 0.020 inches to 0.032 inches, inclusive. In yet another exemplary embodiment, a diameter of an opening in each nozzle in the second set of nozzles 206 is within 0.032 inches to 0.042 inches, inclusive. In still another exemplary embodiment, a diameter of an opening in each nozzle in the second set of nozzles 206 is within 0.028 inches to 0.035 inches, inclusive.

In one exemplary embodiment, a diameter of an opening in each nozzle in the second set of nozzles 206 is approximately equal to 0.034 inches. In another exemplary embodiment, a diameter of an opening in each nozzle in the second set of nozzles 206 is approximately equal to 0.032 inches. In yet another exemplary embodiment, a diameter of an opening in each nozzle in the second set of nozzles 206 is approximately equal to 0.038 inches. In still another exemplary embodiment, a diameter of an opening in each nozzle in the second set of nozzles 206 is approximately equal to 0.035 inches.

Figure 5:
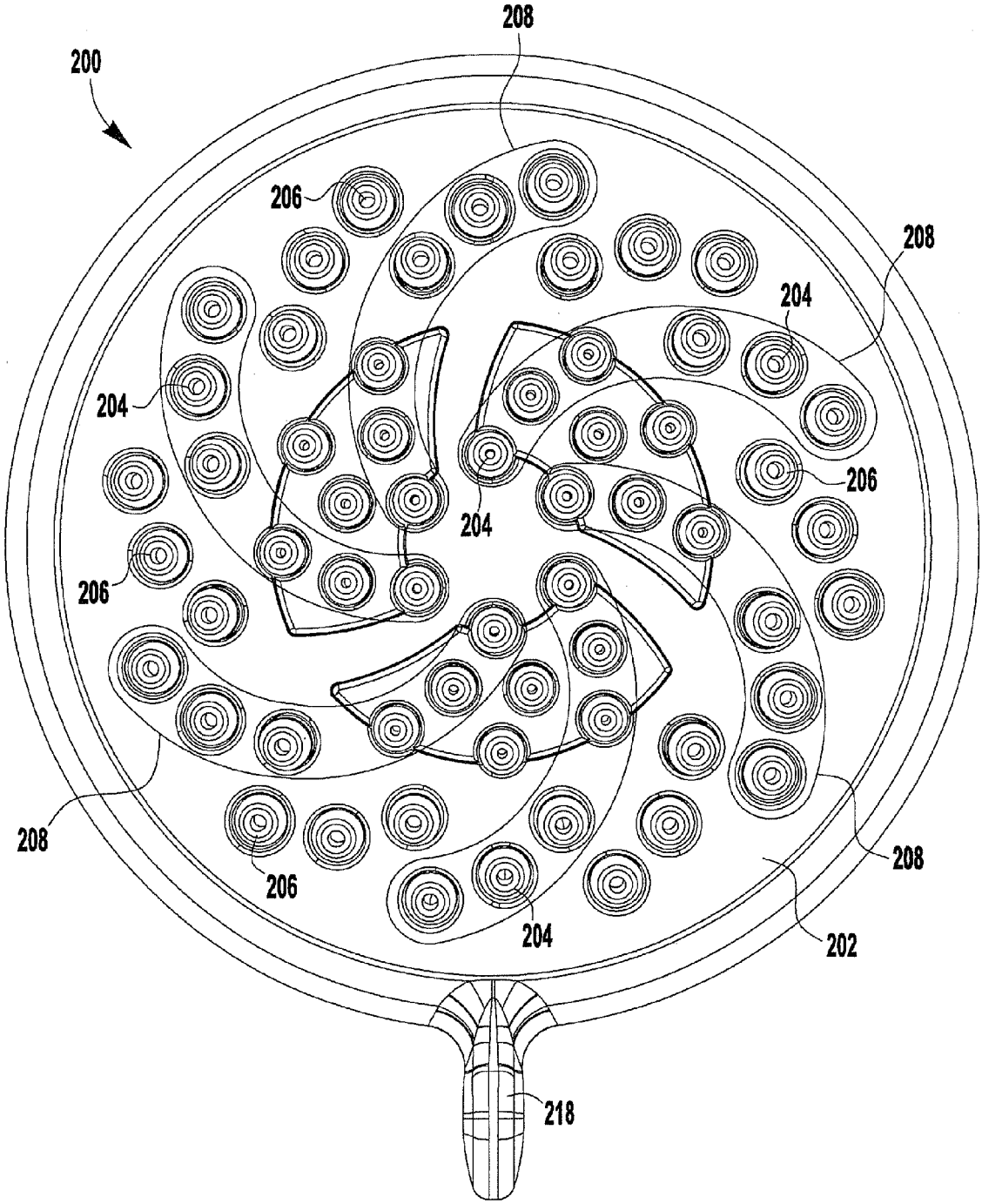
FIG. 5 is a diagram of the multi-function showerhead of FIG. 4 showing a plurality of exemplary first curves.

As shown in FIG. 5, the first set of nozzles 204 is arranged so as to form a plurality of first curves 208. As used herein, a "curve" refers to a line connecting a set of points, wherein the points can be represented by openings of nozzles on a face of a showerhead. The line may or may not be straight. The line may or may not have a constant rate of curvature. Accordingly, the curves can be linear or non-linear. Each first curve 208 passes through a center of an opening in the nozzles forming the first curve. For purposes of illustration, the nozzles 204 forming each first curve 208 are surrounded by a geometric shape. Additionally, only a few of the first curves 208 are labeled in the drawings. Water is discharged from the first curves 208 if the first or third water delivery function is selected. In one exemplary embodiment, each of the first curves 208 is formed from at least three adjacent nozzles in the first set of nozzles 204. In one exemplary embodiment, all of the first curves 208 have the same number of nozzles. In one exemplary embodiment, all of the first curves 208 have approximately the same rate of curvature.

Figure 6:
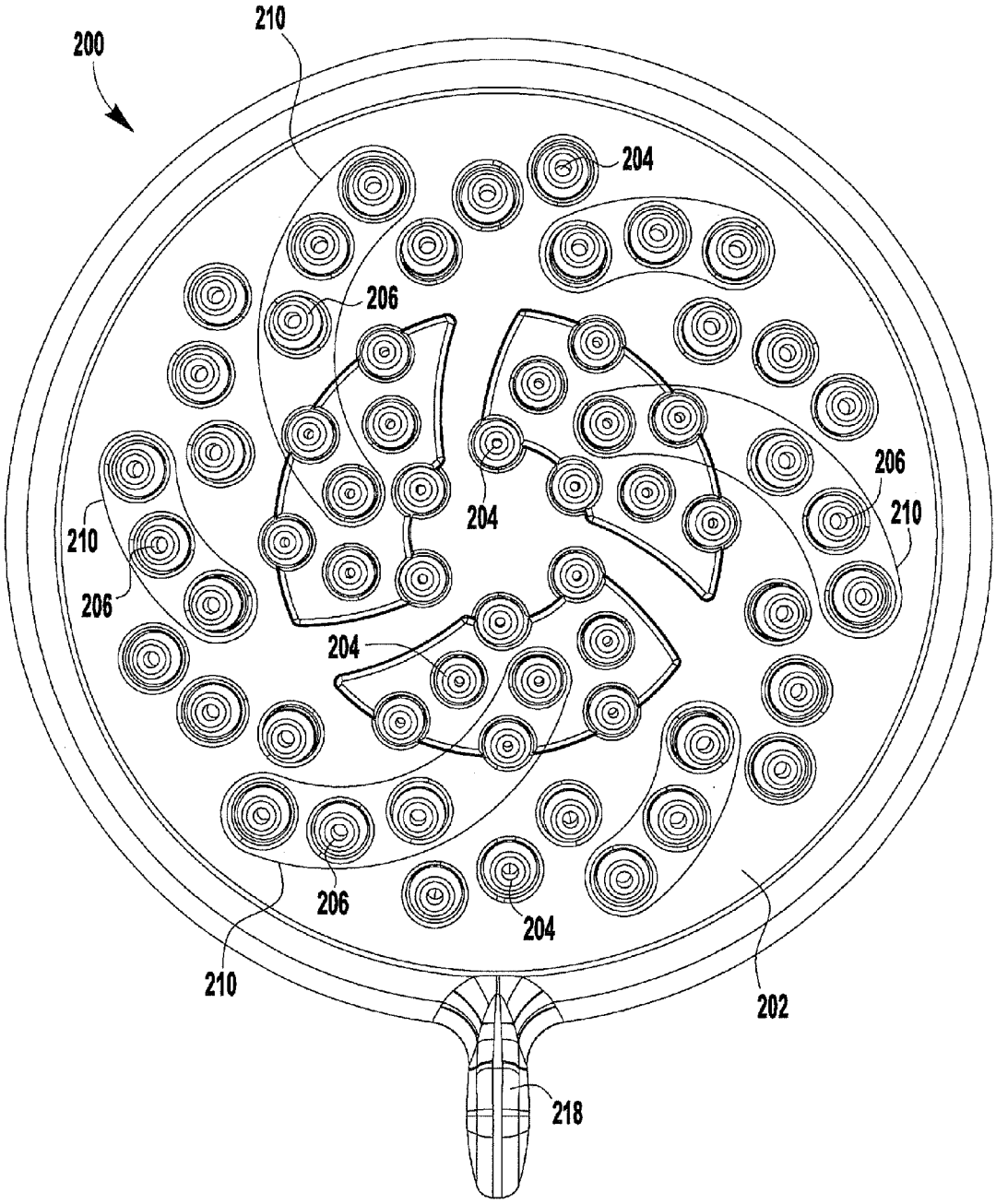
FIG. 6 is a diagram of the multi-function showerhead of FIG. 4 showing a plurality of exemplary second curves.

As shown in FIG. 6, the second set of nozzles 206 is arranged so as to form a plurality of second curves 210. Each second curve 210 passes through a center of an opening in the nozzles forming the second curve. For purposes of illustration, the nozzles 206 forming each second curve 210 are surrounded by a geometric shape. Additionally, only a few of the second curves 210 are labeled in the drawings. Water is discharged from the second curves 210 if the second or third water delivery function is selected. In one exemplary embodiment, each of the second curves 210 is formed from at least three adjacent nozzles in the second set of nozzles 206. In one exemplary embodiment, all of the second curves 210 have the same number of nozzles. In one exemplary embodiment, all of the second curves 210 have approximately the same rate of curvature.

In one exemplary embodiment, all of the first curves 208 and the second curves 210 have the same number of nozzles. In one exemplary embodiment, all of the first curves 208 and the second curves 210 have approximately the same rate of curvature.

Figure 7:
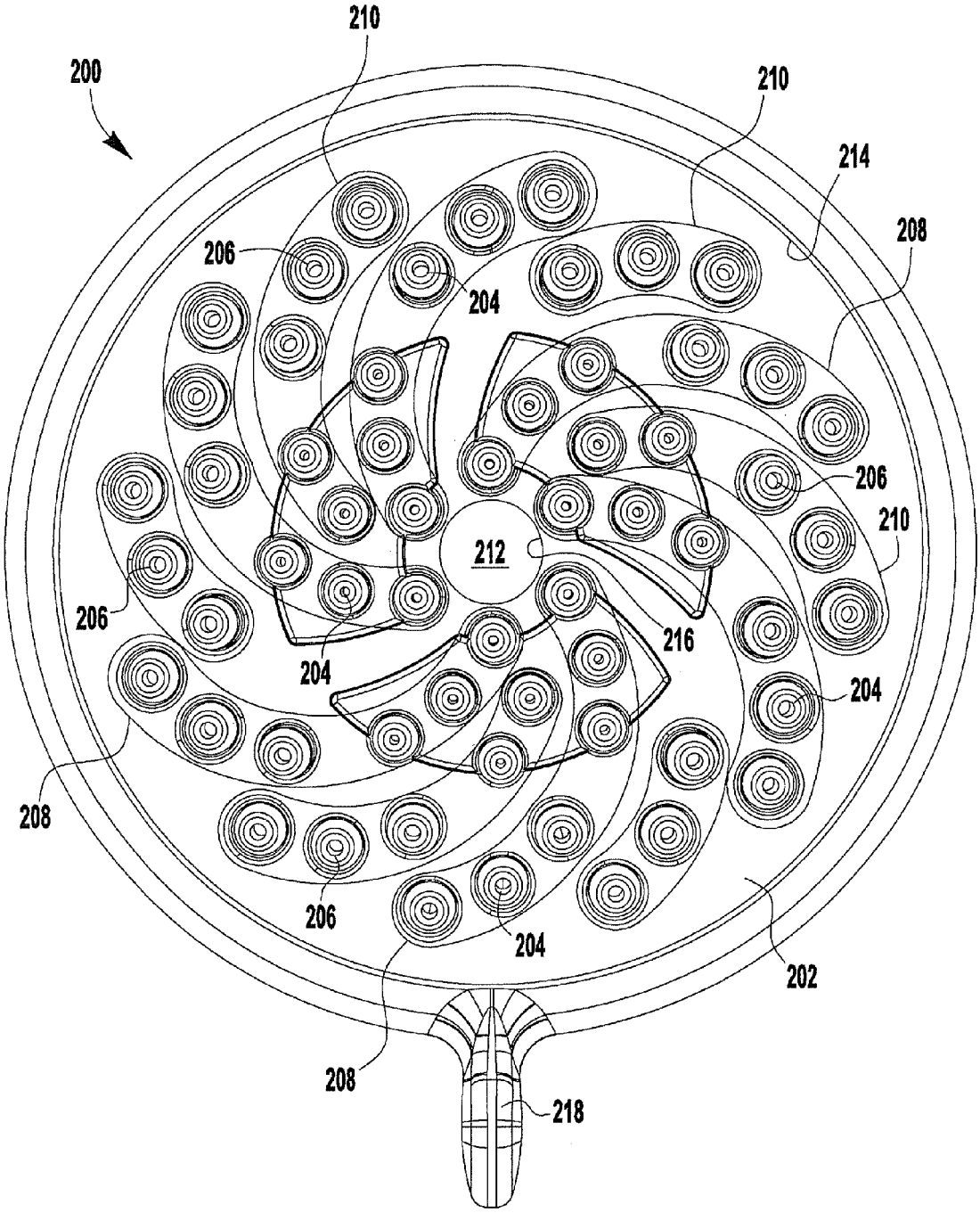
FIG. 7 is a diagram of the multi-function showerhead of FIG. 4 showing the plurality of exemplary first curves interleaved with the plurality of exemplary second curves.
Figure 8:
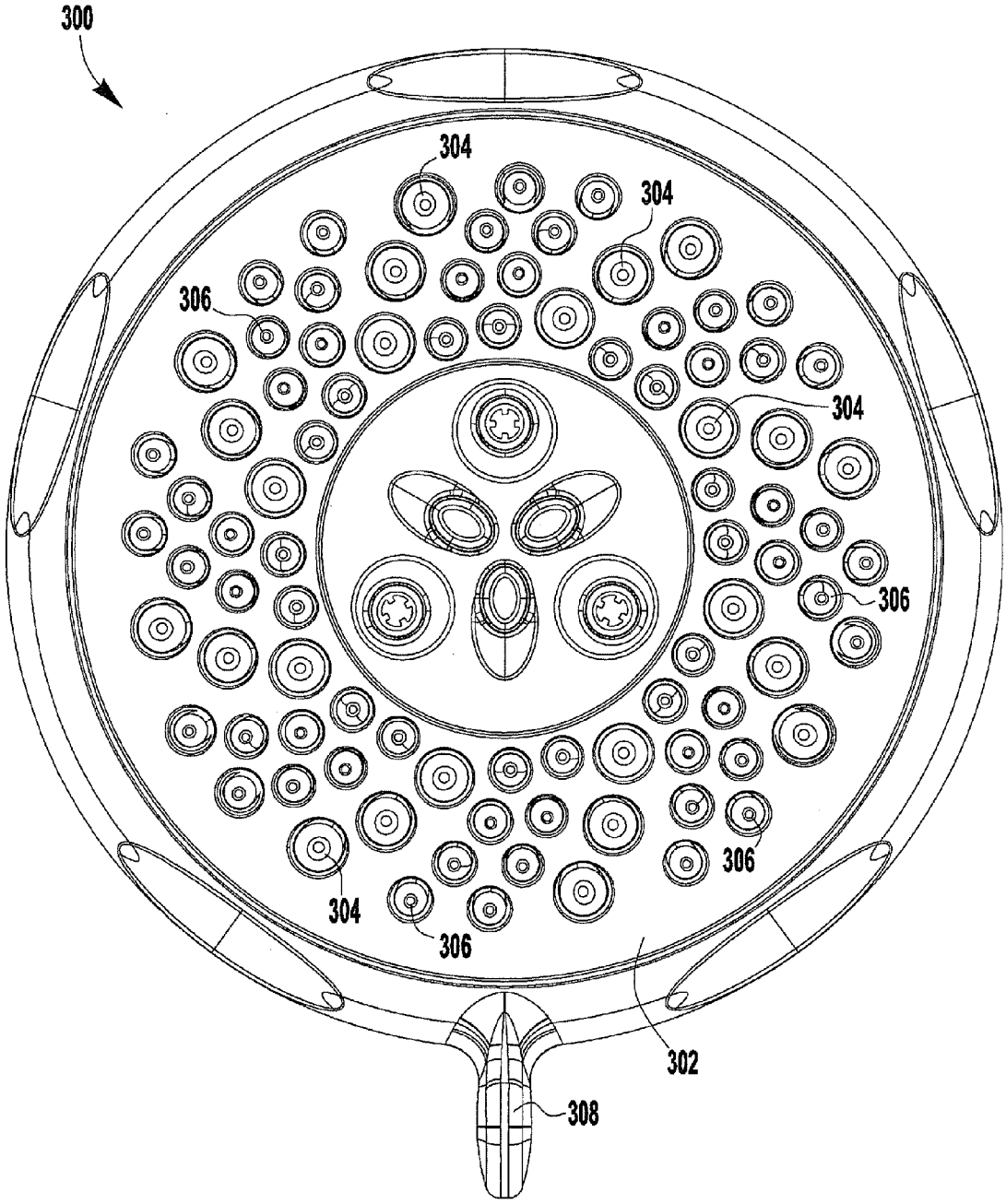
FIG. 8 is a diagram of a multi-function showerhead having multiple distinct sets of nozzles, according to another exemplary embodiment.

As shown in FIG. 7, the first curves 208 and the second curves 210 are interleaved on the face 202 of the showerhead 200. Accordingly, the first set of nozzles 204 and the second set of nozzles 206 do not occupy discrete zones/regions, but instead occupy the same zone/region without any substantial dead zone in the zone/region. As noted above, a dead zone is a space around, between or near the zones/regions that does not have nozzles and, thus, is incapable of discharging water regardless of the selected water delivery function. Because the zone/region with the interleaved curves 208, 210 occupies a large portion of the face 202, only a minimal dead zone 212 is formed on the face 202. As a result, the showerhead 200 produces a coherent and balanced spray pattern that provides a consistent coverage area and a pleasant showering experience for the user, regardless of the selected water delivery function. Furthermore, by interleaving the first curves 208 and the second curves 210, the third water delivery function, which uses both sets of nozzles 204 and 206 simultaneously, is operable to discharge water in a more coherent and balanced manner resulting in an improved showering experience.

Additionally, the number of nozzles in each of the first set of nozzles 204 and the second set of nozzles 206, as well as a corresponding total cross-sectional area (i.e., flow area) of the openings in the first set of nozzles 204 and the second set of nozzles 206, are chosen to provide a pleasant sensation that contributes to the improved showering experience, regardless of the selected water delivery function.

In one exemplary embodiment, the first set of nozzles 204 has from 15 to 45 nozzles, inclusive, with a total cross-sectional area of the openings in the nozzles 204 being within 0.010 $in^2$ to 0.045 $in^2$, inclusive. In another exemplary embodiment, the first set of nozzles 204 has from 19 to 42 nozzles, inclusive, with a total cross-sectional area of the openings in the nozzles 204 being within 0.015 $in^2$ to 0.040 $in^2$, inclusive. In yet another exemplary embodiment, the first set of nozzles 204 has from 22 to 38 nozzles, inclusive, with a total cross-sectional area of the openings in the nozzles 204 being within 0.018 $in^2$ to 0.037 $in^2$, inclusive. In still another exemplary embodiment, the first set of nozzles 204 has from 24 to 36 nozzles, inclusive, with a total cross-sectional area of the openings in the nozzles 204 being within 0.019 $in^2$ to 0.041 $in^2$, inclusive.

In one exemplary embodiment, the first set of nozzles 204 has 24 nozzles with a total cross-sectional area of the openings in the nozzles 204 being approximately 0.022 $in^2$. In another exemplary embodiment, the first set of nozzles 204 has 24 nozzles with a total cross-sectional area of the openings in the nozzles 204 being approximately 0.033 $in^2$. In yet another exemplary embodiment, the first set of nozzles 204 has 36 nozzles with a total cross-sectional area of the openings in the nozzles 204 being approximately 0.025 $in^2$. In still another exemplary embodiment, the first set of nozzles 204 has 30 nozzles with a total cross-sectional area of the openings in the nozzles 204 being approximately 0.038 $in^2$.

In one exemplary embodiment, the second set of nozzles 206 has from 20 to 90 nozzles, inclusive, with a total cross-sectional area of the openings in the nozzles 206 being within 0.010 $in^2$ to 0.080 $in^2$, inclusive. In another exemplary embodiment, the second set of nozzles 206 has from 23 to 70 nozzles, inclusive, with a total cross-sectional area of the openings in the nozzles 206 being within 0.012 $in^2$ to 0.060 $in^2$, inclusive. In yet another exemplary embodiment, the second set of nozzles 206 has from 25 to 65 nozzles, inclusive, with a total cross-sectional area of the openings in the nozzles 206 being within 0.018 $in^2$ to 0.053 $in^2$, inclusive. In still another exemplary embodiment, the second set of nozzles 206 has from 27 to 70 nozzles, inclusive, with a total cross-sectional area of the openings in the nozzles 206 being within 0.020 $in^2$ to 0.067 $in^2$, inclusive.

In one exemplary embodiment, the second set of nozzles 206 has 36 nozzles with a total cross-sectional area of the openings in the nozzles 206 being approximately 0.033 $in^2$. In another exemplary embodiment, the second set of nozzles 206 has 64 nozzles with a total cross-sectional area of the openings in the nozzles 206 being approximately 0.051 $in^2$. In yet another exemplary embodiment, the second set of nozzles 206 has 27 nozzles with a total cross-sectional area of the openings in the nozzles 206 being approximately 0.031 $in^2$. In still another exemplary embodiment, the second set of nozzles 206 has 70 nozzles with a total cross-sectional area of the openings in the nozzles 206 being approximately 0.067 $in^2$.

The nozzle characteristics described herein (e.g., diameter of opening and total cross-sectional area) are based on nozzles having substantially circular openings. It will be appreciated that the general inventive concept encompasses other nozzle types, including nozzles having non-circular openings. The equivalent nozzle characteristics of a nozzle having a non-circular opening can be readily determined.

In one exemplary embodiment, the first curves 208 and the second curves 210 are considered to be interleaved if a zone/region encompassing the first curves 208 and a zone/region encompassing the second curves 210 substantially overlap. As shown in FIG. 7, for the showerhead 200, the zone/region encompassing the first curves 208 extends between an outer edge 214 of the face 202 to an outer edge 216 of the dead zone 212. Likewise, the zone/region encompassing the second curves 210 extends between the outer edge 214 of the face 202 to the outer edge 216 of the dead zone 212. Accordingly, the zone/region encompassing the first curves 208 is the same as the zone/region encompassing the second curves 210, such that the zones/regions substantially overlap and the curves 208 and 210 are considered to be interleaved.

In another exemplary embodiment, the first curves 208 and the second curves 210 are considered to be interleaved if at least one nozzle in each first curve 208 is located between two adjacent second curves 210 on the face 202 and/or at least one nozzle in each second curve 210 is located between two adjacent first curves 208 on the face 202. As shown in FIG. 7, for the showerhead 200, at least one nozzle 204 in each of the first curves 208 is located between two adjacent second curves 210. Additionally, at least one nozzle 206 in each of the second curves 210 is located between two adjacent first curves 208. Accordingly, the first curves 208 and the second curves 210 are considered to be interleaved.

. In yet another exemplary embodiment, the first curves 208 and the second curves 210 are considered to be interleaved if at least 50% of the nozzles in each first curve 208 are located between two adjacent second curves 210 on the face 202 and/or at least 50% of the nozzles in each second curve 210 are located between two adjacent first curves 208 on the face 202.

In another exemplary embodiment, the first curves 208 and the second curves 210 are considered to be interleaved if all of the nozzles in each first curve 208 are located between two adjacent second curves 210 on the face 202 and/or all of the nozzles in each second curve 210 are located between adjacent two first curves 208 on the face 202.

In still other exemplary embodiments, more than one of the first curves 208 can be interleaved between each adjacent pair of the second curves 210. Alternatively, more than one of the second curves 210 can be interleaved between each adjacent pair of the first curves 208.

In view of the above, by interleaving the first curves 208 formed by the first set of nozzles 204 and the second curves 210 formed by the second set of nozzles 206, a coherent and balanced spray pattern is achieved across the different water delivery functions. As a result, the spray pattern provides good coverage of a user's body across the different water delivery functions, while avoiding any unpleasant sensations resulting from the incoherent and unbalanced spray patterns of conventional multi-function showerheads. Additionally, the interleaved curves (e.g., the first curves 208 and the second curves 210) result in a nozzle arrangement which users may find aesthetically pleasing.

A multi-function showerhead according to another exemplary embodiment is shown as a five-function showerhead 300 (hereinafter, the "showerhead 300") in FIGS. 8-11. The showerhead 300 includes a face 302 in which a plurality of nozzles are disposed. The plurality of nozzles forms a plurality of sets of nozzles including a first set of nozzles 304 and a second set of nozzles 306 on the face 302. For purposes of illustration, only a few of the nozzles 304, 306 are labeled in the drawings. In one exemplary embodiment, the nozzles 304, 306 extend through corresponding openings in the face 302.

The first set of nozzles 304 corresponds to a first water delivery function and the second set of nozzles 306 corresponds to a second water delivery function. In one exemplary embodiment, a third water delivery function is provided by discharging water through the first set of nozzles 304 and the second set of nozzles 306 simultaneously. The showerhead 300 uses other sets of nozzles to achieve one or more of the remaining water delivery functions (e.g., a fourth water delivery function and a fifth water delivery function). Additionally, two or more of any of the sets of nozzles of the showerhead 300 can be combined to achieve one or more of the remaining water delivery functions (e.g., the fourth water delivery function and the fifth water delivery function). An actuator 308 is located, for example, on the showerhead 300 to allow a user to select among the different water delivery functions.

In one exemplary embodiment, the first set of nozzles 304 has at least 9 nozzles and the second set of nozzles 306 has at least 9 nozzles. As shown in FIGS. 8-11, the showerhead 300 has 24 nozzles in the first set of nozzles 304 and 64 nozzles in the second set of nozzles 306. The nozzles in the first set of nozzles 304 may or may not have the same dimensions. The nozzles in the second set of nozzles 306 may or may not have the same dimensions. The nozzles in both the first set of nozzles 304 and the second set of nozzles 306 may or may not have the same dimensions.

In one exemplary embodiment, a diameter of an opening in each nozzle in the first set of nozzles 304 is within 0.032 inches to 0.042 inches, inclusive. In another exemplary embodiment, a diameter of an opening in each nozzle in the first set of nozzles 304 is within 0.036 inches to 0.046 inches, inclusive. In yet another exemplary embodiment, a diameter of an opening in each nozzle in the first set of nozzles 304 is within 0.028 inches to 0.038 inches, inclusive. In still another exemplary embodiment, a diameter of an opening in each nozzle in the first set of nozzles 304 is within 0.030 inches to 0.040 inches, inclusive.

In one exemplary embodiment, a diameter of an opening in each nozzle in the first set of nozzles 304 is approximately equal to 0.034 inches. In another exemplary embodiment, a diameter of an opening in each nozzle in the first set of nozzles 304 is approximately equal to 0.042 inches. In yet another exemplary embodiment, a diameter of an opening in each nozzle in the first set of nozzles 304 is approximately equal to 0.030 inches. In still another exemplary embodiment, a diameter of an opening in each nozzle in the first set of nozzles 304 is approximately equal to 0.040 inches.

In one exemplary embodiment, a diameter of an opening in each nozzle in the second set of nozzles 306 is within 0.028 inches to 0.038 inches, inclusive. In another exemplary embodiment, a diameter of an opening in each nozzle in the second set of nozzles 306 is within 0.020 inches to 0.032 inches, inclusive. In yet another exemplary embodiment, a diameter of an opening in each nozzle in the second set of nozzles 306 is within 0.032 inches to 0.042 inches, inclusive. In still another exemplary embodiment, a diameter of an opening in each nozzle in the second set of nozzles 306 is within 0.028 inches to 0.035 inches, inclusive.

In one exemplary embodiment, a diameter of an opening in each nozzle in the second set of nozzles 306 is approximately equal to 0.034 inches. In another exemplary embodiment, a diameter of an opening in each nozzle in the second set of nozzles 306 is approximately equal to 0.032 inches. In yet another exemplary embodiment, a diameter of an opening in each nozzle in the second set of nozzles 306 is approximately equal to 0.038 inches. In still another exemplary embodiment, a diameter of an opening in each nozzle in the second set of nozzles 306 is approximately equal to 0.035 inches.

Figure 9:
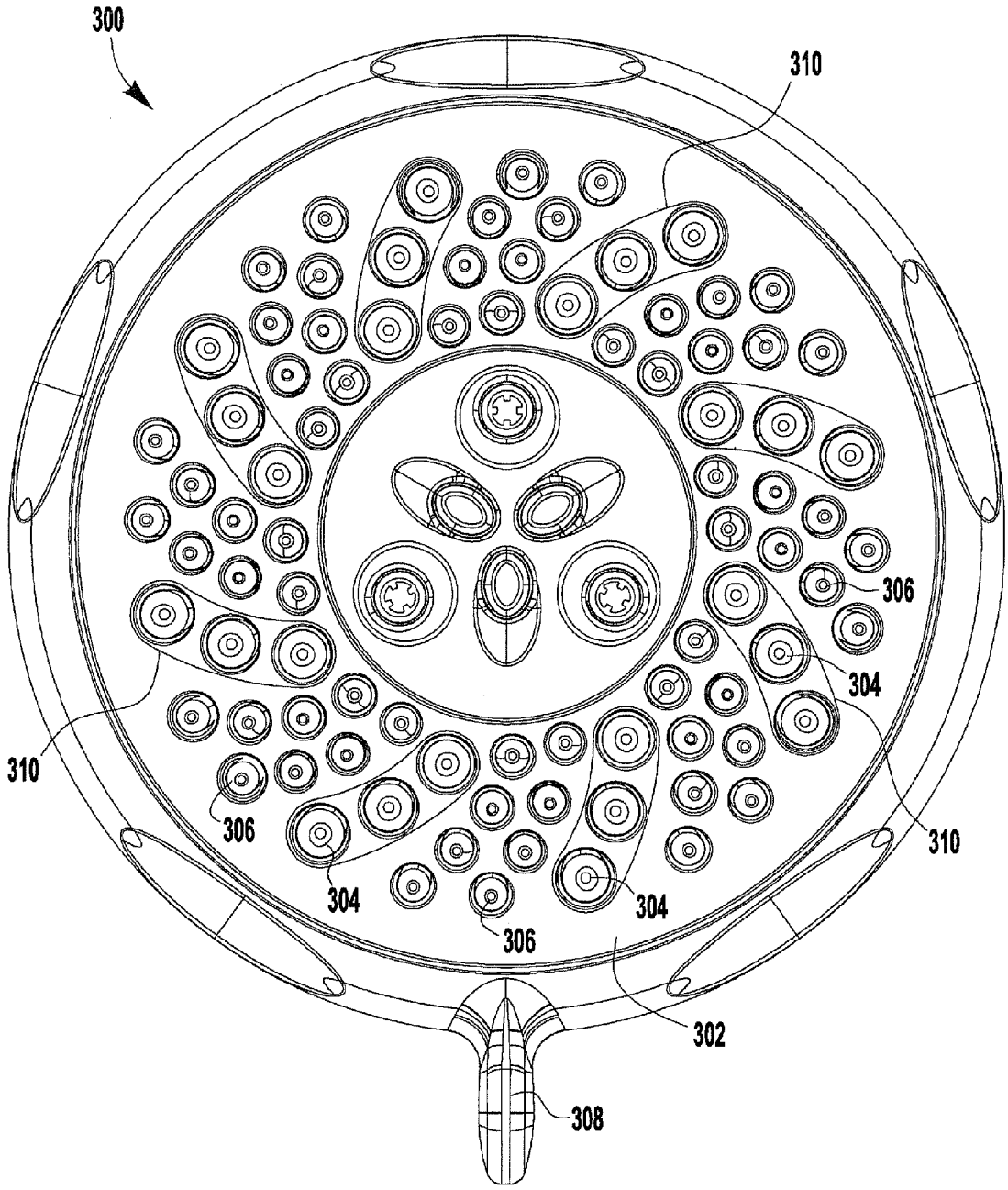
FIG. 9 is a diagram of the multi-function showerhead of FIG. 8 showing a plurality of exemplary first curves.

As shown in FIG. 9, the first set of nozzles 304 is arranged so as to form a plurality of first curves 310. For purposes of illustration, the nozzles 304 forming each first curve 310 are surrounded by a geometric shape. Additionally, only a few of the first curves 310 are labeled in the drawings. Water is discharged from the first curves 310 if the first water delivery function is selected. In one exemplary embodiment, each of the first curves 310 is formed from at least three adjacent nozzles in the first set of nozzles 304. In one exemplary embodiment, all of the first curves 310 have the same number of nozzles. In one exemplary embodiment, all of the first curves 310 have approximately the same rate of curvature.

Figure 10:
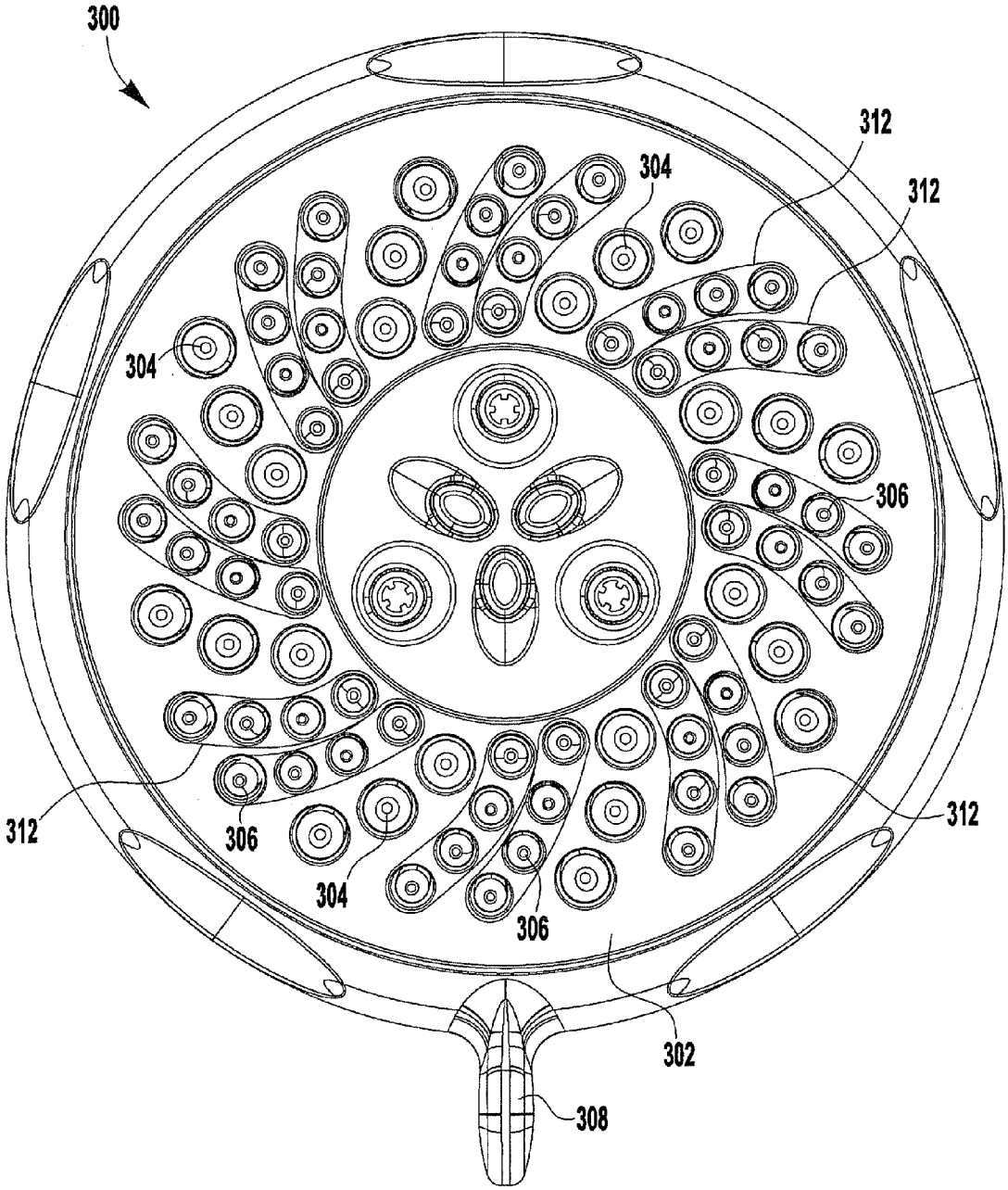
FIG. 10 is a diagram of the multi-function showerhead of FIG. 8 showing a plurality of exemplary second curves.

As shown in FIG. 10, the second set of nozzles 306 is arranged so as to form a plurality of second curves 312. For purposes of illustration, the nozzles 306 forming each second curve 312 are surrounded by a geometric shape. Additionally, only a few of the second curves 312 are labeled in the drawings. Water is discharged from the second curves 312 if the second water delivery function is selected. In one exemplary embodiment, each of the second curves 312 is formed from at least three adjacent nozzles in the second set of nozzles 306. In one exemplary embodiment, all of the second curves 312 have the same number of nozzles. In one exemplary embodiment, all of the second curves 312 have approximately the same rate of curvature.

In one exemplary embodiment, all of the first curves 310 and the second curves 312 have the same number of nozzles. In one exemplary embodiment, all of the first curves 310 and the second curves 312 have approximately the same rate of curvature.

Figure 11:
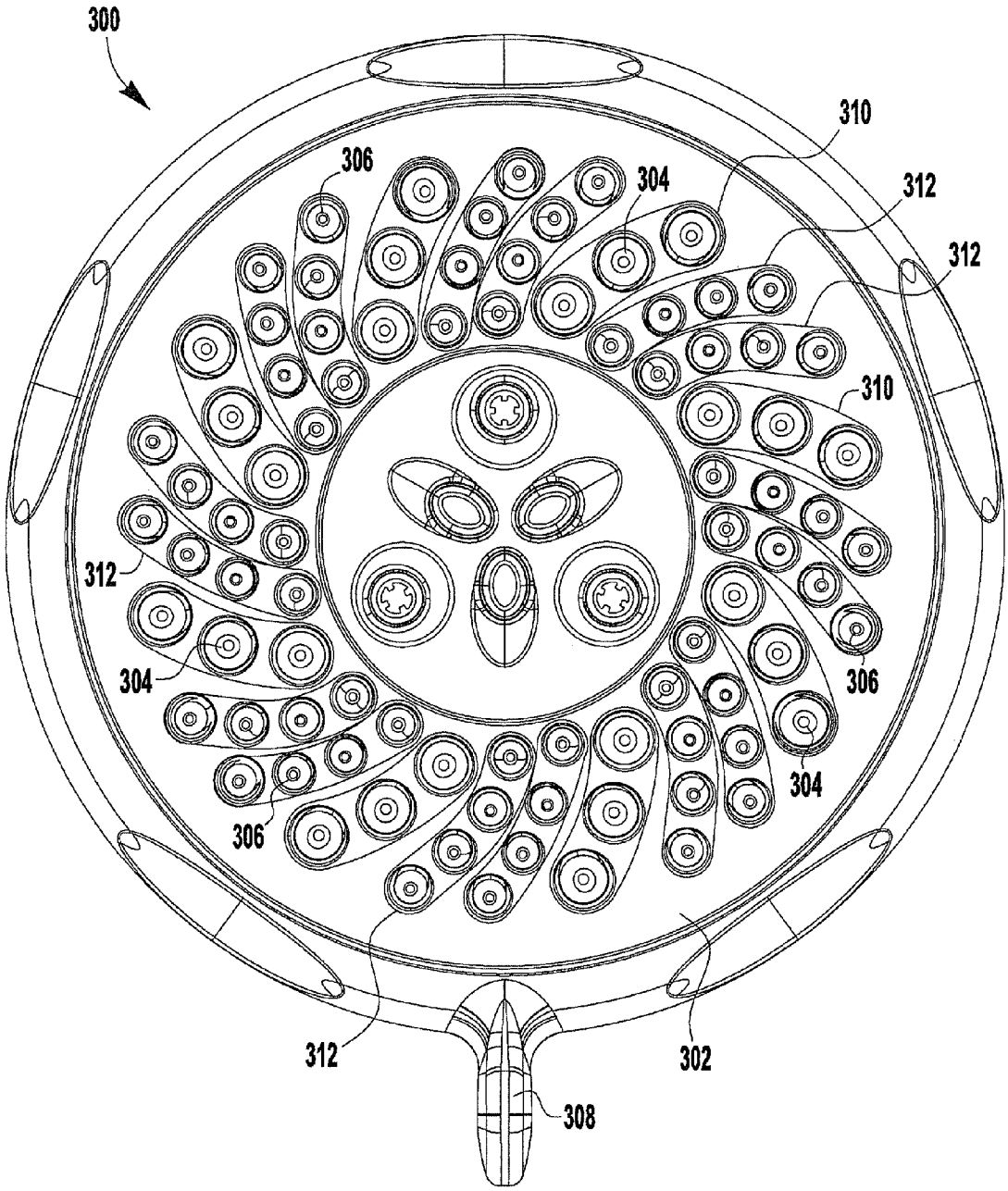
FIG. 11 is a diagram of the multi-function showerhead of FIG. 8 showing the plurality of exemplary first curves interleaved with the plurality of exemplary second curves.
Figure 12:
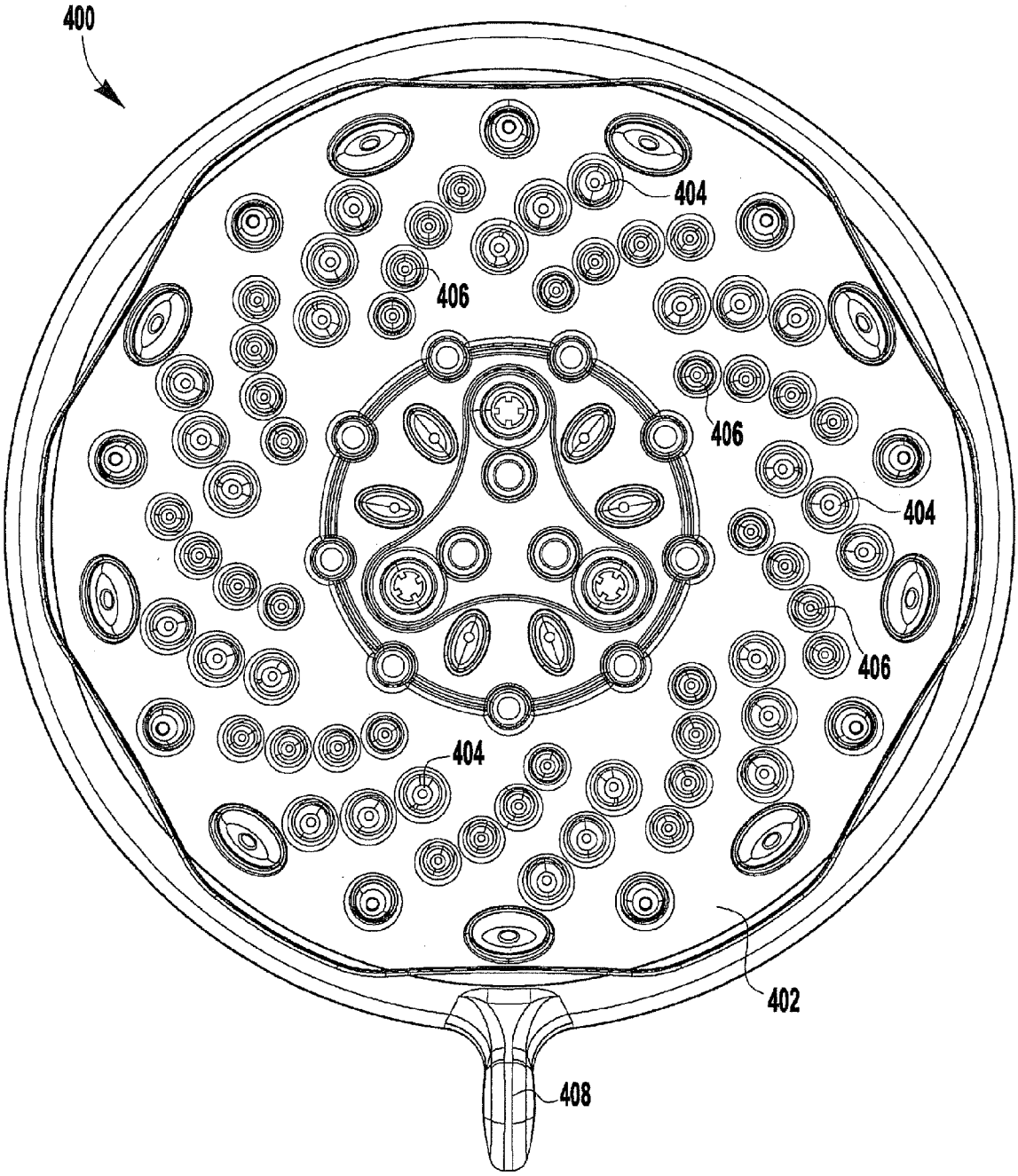
FIG. 12 is a diagram of a multi-function showerhead having multiple distinct sets of nozzles, according to yet another exemplary embodiment.

As shown in FIG. 11, the first curves 310 and the second curves 312 are interleaved on the face 302 of the showerhead 300. Accordingly, the first set of nozzles 304 and the second set of nozzles 306 do not occupy discrete zones/regions, but instead occupy the same zone/region without any substantial dead zone therein. Because the zone/region with the interleaved curves 310, 312 occupies a large portion of the face 302, only a minimal dead zone is formed on the face 302. As a result, the showerhead 300 produces a coherent and balanced spray pattern that provides a consistent coverage area and a pleasant showering experience for the user, regardless of the selected water delivery function. Furthermore, by interleaving the first curves 310 and the second curves 312, the third water delivery function, which uses both sets of nozzles 304 and 306 simultaneously, is operable to discharge water in a more coherent and balanced manner resulting in an improved showering experience.

Additionally, the number of nozzles in each of the first set of nozzles 304 and the second set of nozzles 306, as well as a corresponding total cross-sectional area (i.e., flow area) of the openings in the first set of nozzles 304 and the second set of nozzles 306, are chosen to provide a pleasant sensation that contributes to the improved showering experience, regardless of the selected water delivery function.

In one exemplary embodiment, the first set of nozzles 304 has from 15 to 45 nozzles, inclusive, with a total cross-sectional area of the openings in the nozzles 304 being within 0.010 $in^2$ to 0.045 $in^2$, inclusive. In another exemplary embodiment, the first set of nozzles 304 has from 19 to 42 nozzles, inclusive, with a total cross-sectional area of the openings in the nozzles 304 being within 0.015 $in^2$ to 0.040 $in^2$, inclusive. In yet another exemplary embodiment, the first set of nozzles 304 has from 22 to 38 nozzles, inclusive, with a total cross-sectional area of the openings in the nozzles 304 being within 0.018 $in^2$ to 0.037 $in^2$, inclusive. In still another exemplary embodiment, the first set of nozzles 304 has from 24 to 36 nozzles, inclusive, with a total cross-sectional area of the openings in the nozzles 304 being within 0.019 $in^2$ to 0.041 $in^2$, inclusive.

In one exemplary embodiment, the first set of nozzles 304 has 24 nozzles with a total cross-sectional area of the openings in the nozzles 304 being approximately 0.022 $in^2$. In another exemplary embodiment, the first set of nozzles 304 has 24 nozzles with a total cross-sectional area of the openings in the nozzles 304 being approximately 0.033 $in^2$. In yet another exemplary embodiment, the first set of nozzles 304 has 36 nozzles with a total cross-sectional area of the openings in the nozzles 304 being approximately 0.025 $in^2$. In still another exemplary embodiment, the first set of nozzles 304 has 30 nozzles with a total cross-sectional area of the openings in the nozzles 304 being approximately 0.038 $in^2$.

In one exemplary embodiment, the second set of nozzles 306 has from 20 to 90 nozzles, inclusive, with a total cross-sectional area of the openings in the nozzles 306 being within 0.010 $in^2$ to 0.080 $in^2$, inclusive. In another exemplary embodiment, the second set of nozzles 306 has from 23 to 70 nozzles, inclusive, with a total cross-sectional area of the openings in the nozzles 306 being within 0.012 $in^2$ to 0.060 $in^2$, inclusive. In yet another exemplary embodiment, the second set of nozzles 306 has from 25 to 65 nozzles, inclusive, with a total cross-sectional area of the openings in the nozzles 306 being within 0.018 $in^2$ to 0.053 $in^2$, inclusive. In still another exemplary embodiment, the second set of nozzles 306 has from 27 to 70 nozzles, inclusive, with a total cross-sectional area of the openings in the nozzles 306 being within 0.020 $in^2$ to 0.067 $in^2$, inclusive.

In one exemplary embodiment, the second set of nozzles 306 has 36 nozzles with a total cross-sectional area of the openings in the nozzles 306 being approximately 0.033 $in^2$. In another exemplary embodiment, the second set of nozzles 306 has 64 nozzles with a total cross-sectional area of the openings in the nozzles 306 being approximately 0.051 $in^2$. In yet another exemplary embodiment, the second set of nozzles 306 has 27 nozzles with a total cross-sectional area of the openings in the nozzles 306 being approximately 0.031 $in^2$. In still another exemplary embodiment, the second set of nozzles 306 has 70 nozzles with a total cross-sectional area of the openings in the nozzles 306 being approximately 0.067 $in^2$.

The nozzle characteristics described herein (e.g., diameter of openings and total cross-sectional area of openings) are based on nozzles having substantially circular openings. It will be appreciated that the general inventive concept encompasses other nozzle types, including nozzles having non-circular openings. The equivalent nozzle characteristics of a nozzle having a non-circular opening can be readily determined.

The examples of interleaving described above in conjunction with FIGS. 4-7 apply to FIGS. 8-11 as well.

A multi-function showerhead according to still another exemplary embodiment is shown as a seven-function showerhead 400 (hereinafter, the "showerhead 400") in FIGS. 12-15. The showerhead 400 includes a face 402 in which a plurality of nozzles are disposed. The plurality of nozzles forms a plurality of sets of nozzles including a first set of nozzles 404 and a second set of nozzles 406 on the face 402. For purposes of illustration, only a few of the nozzles 404, 406 are labeled in the drawings. In one exemplary embodiment, the nozzles 404, 406 extend through corresponding openings in the face 402.

The first set of nozzles 404 corresponds to a first water delivery function and the second set of nozzles 406 corresponds to a second water delivery function. In one exemplary embodiment, a third water delivery function is provided by discharging water through the first set of nozzles 404 and the second set of nozzles 406 simultaneously. The showerhead 400 uses other sets of nozzles to achieve one or more of the remaining water delivery functions (e.g., a fourth water delivery function, a fifth water delivery function, a sixth water delivery function and a seventh water delivery function). Additionally, two or more of any of the sets of nozzles of the showerhead 400 can be combined to achieve one or more of the remaining water delivery functions (e.g., the fourth water delivery function, the fifth water delivery function, the sixth water delivery function and the seventh water delivery function). An actuator 408 is located, for example, on the showerhead 400 to allow a user to select among the different water delivery functions.

In one exemplary embodiment, the first set of nozzles 404 has at least 9 nozzles and the second set of nozzles 406 has at least 9 nozzles. As shown in FIGS. 12-15, the showerhead 400 has 27 nozzles in the first set of nozzles 404 and 36 nozzles in the second set of nozzles 406. The nozzles in the first set of nozzles 404 may or may not have the same dimensions. The nozzles in the second set of nozzles 406 may or may not have the same dimensions. The nozzles in both the first set of nozzles 404 and the second set of nozzles 406 may or may not have the same dimensions.

In one exemplary embodiment, a diameter of an opening in each nozzle in the first set of nozzles 404 is within 0.032 inches to 0.042 inches, inclusive. In another exemplary embodiment, a diameter of an opening in each nozzle in the first set of nozzles 404 is within 0.036 inches to 0.046 inches, inclusive. In yet another exemplary embodiment, a diameter of an opening in each nozzle in the first set of nozzles 404 is within 0.028 inches to 0.038 inches, inclusive. In still another exemplary embodiment, a diameter of an opening in each nozzle in the first set of nozzles 404 is within 0.030 inches to 0.040 inches, inclusive.

In one exemplary embodiment, a diameter of an opening in each nozzle in the first set of nozzles 404 is approximately equal to 0.034 inches. In another exemplary embodiment, a diameter of an opening in each nozzle in the first set of nozzles 404 is approximately equal to 0.042 inches. In yet another exemplary embodiment, a diameter of an opening in each nozzle in the first set of nozzles 404 is approximately equal to 0.030 inches. In still another exemplary embodiment, a diameter of an opening in each nozzle in the first set of nozzles 404 is approximately equal to 0.040 inches.

In one exemplary embodiment, a diameter of an opening in each nozzle in the second set of nozzles 406 is within 0.028 inches to 0.038 inches, inclusive. In another exemplary embodiment, a diameter of an opening in each nozzle in the second set of nozzles 406 is within 0.020 inches to 0.032 inches, inclusive. In yet another exemplary embodiment, a diameter of an opening in each nozzle in the second set of nozzles 406 is within 0.032 inches to 0.042 inches, inclusive. In still another exemplary embodiment, a diameter of an opening in each nozzle in the second set of nozzles 406 is within 0.028 inches to 0.035 inches, inclusive.

In one exemplary embodiment, a diameter of an opening in each nozzle in the second set of nozzles 406 is approximately equal to 0.034 inches. In another exemplary embodiment, a diameter of an opening in each nozzle in the second set of nozzles 406 is approximately equal to 0.032 inches. In yet another exemplary embodiment, a diameter of an opening in each nozzle in the second set of nozzles 406 is approximately equal to 0.038 inches. In still another exemplary embodiment, a diameter of an opening in each nozzle in the second set of nozzles 406 is approximately equal to 0.035 inches.

Figure 13:
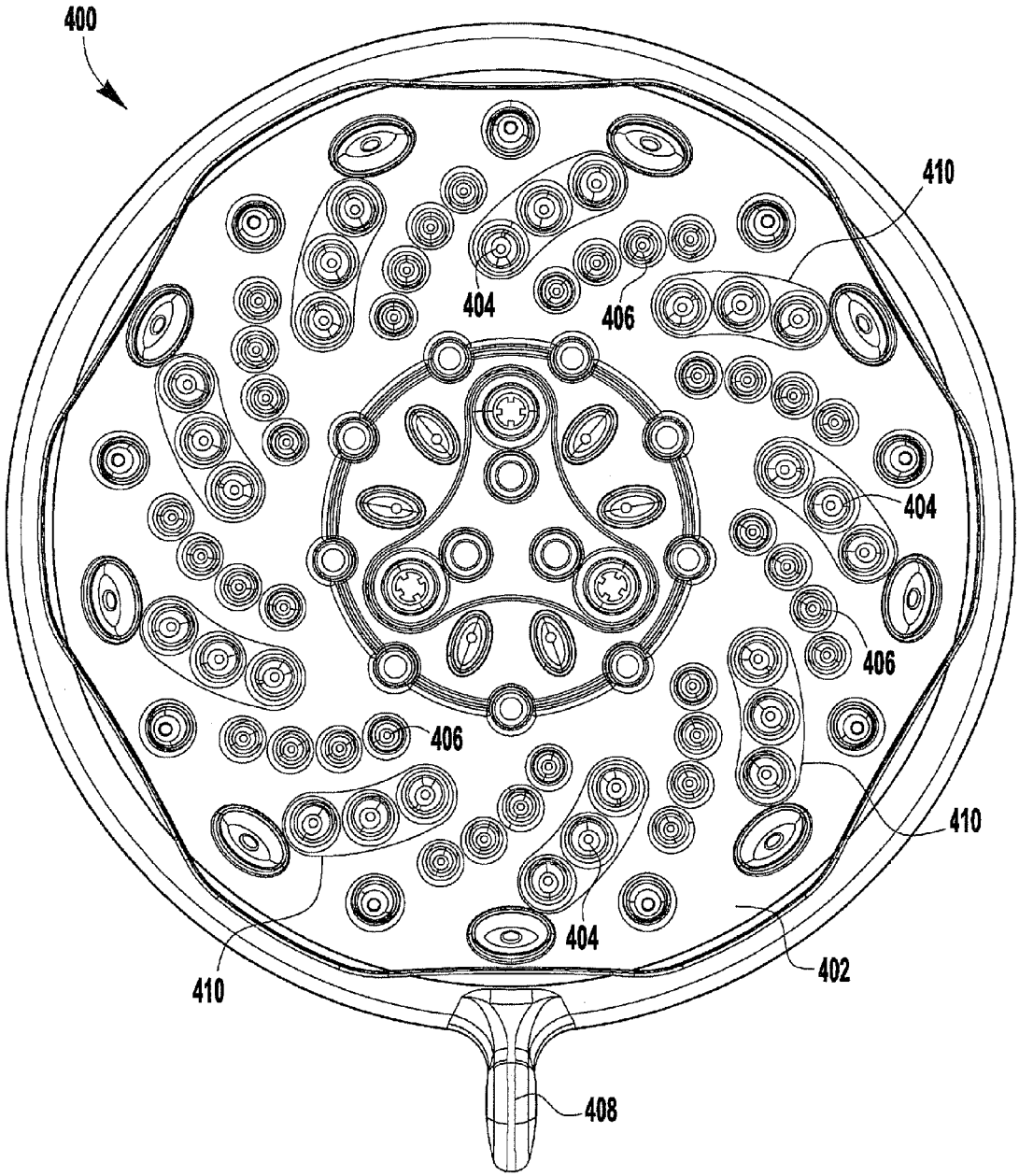
FIG. 13 is a diagram of the multi-function showerhead of FIG. 12 showing a plurality of exemplary first curves.

As shown in FIG. 13, the first set of nozzles 404 is arranged so as to form a plurality of first curves 410. For purposes of illustration, the nozzles 404 forming each first curve 410 are surrounded by a geometric shape. Additionally, only a few of the first curves 410 are labeled in the drawings. Water is discharged from the first curves 410 if the first water delivery function is selected. In one exemplary embodiment, each of the first curves 410 is formed from at least three adjacent nozzles in the first set of nozzles 404. In one exemplary embodiment, all of the first curves 410 have the same number of nozzles. In one exemplary embodiment, all of the first curves 410 have approximately the same rate of curvature.

Figure 14:
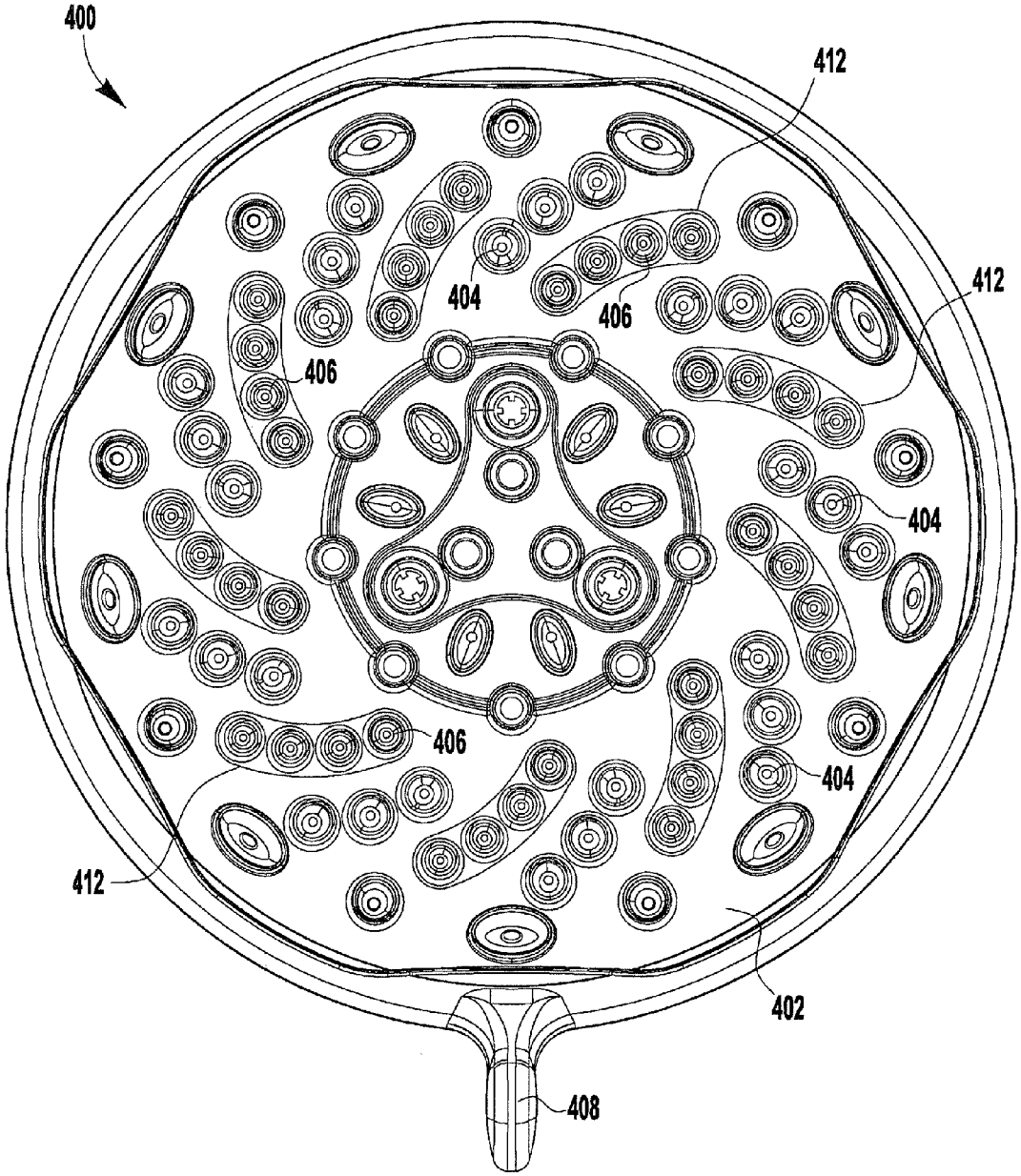
FIG. 14 is a diagram of the multi-function showerhead of FIG. 12 showing a plurality of exemplary second curves.

As shown in FIG. 14, the second set of nozzles 406 is arranged so as to form a plurality of second curves 412. For purposes of illustration, the nozzles 406 forming each second curve 412 are surrounded by a geometric shape. Additionally, only a few of the second curves 412 are labeled in the drawings. Water is discharged from the second curves 412 if the second water delivery function is selected. In one exemplary embodiment, each of the second curves 412 is formed from at least three adjacent nozzles in the second set of nozzles 406. In one exemplary embodiment, all of the second curves 412 have the same number of nozzles. In one exemplary embodiment, all of the second curves 412 have approximately the same rate of curvature.

In one exemplary embodiment, all of the first curves 410 and the second curves 412 have the same number of nozzles. In one exemplary embodiment, all of the first curves 410 and the second curves 412 have approximately the same rate of curvature.

Figure 15:
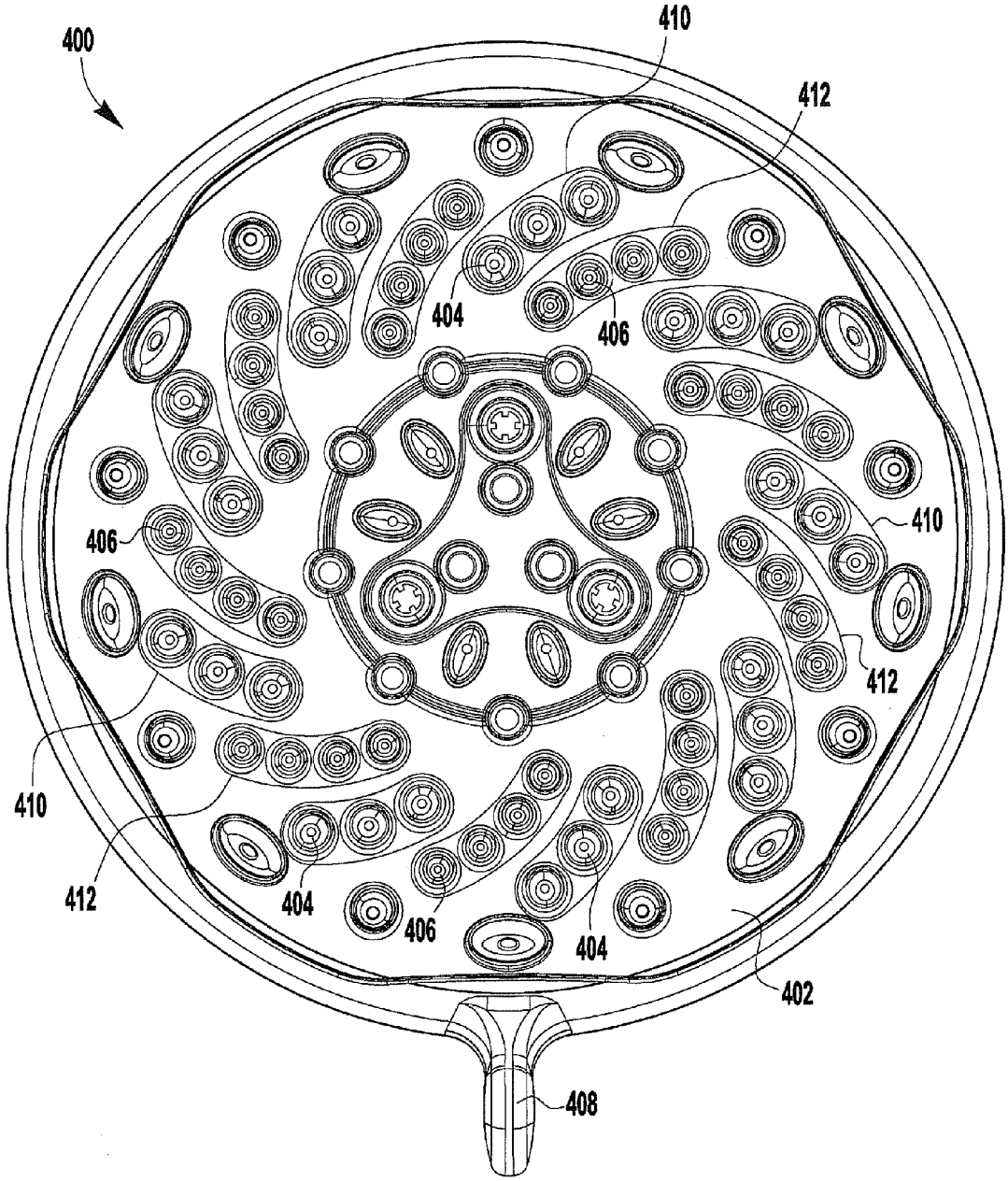
FIG. 15 is a diagram of the multi-function showerhead of FIG. 12 showing the plurality of exemplary first curves interleaved with the plurality of exemplary second curves.

As shown in FIG. 15, the first curves 410 and the second curves 412 are interleaved on the face 402 of the showerhead 400. Accordingly, the first set of nozzles 404 and the second set of nozzles 406 do not occupy discrete zones/regions, but instead occupy the same zone/region without any substantial dead zone therein. Because the zone/region with the interleaved curves 410, 412 occupies a large portion of the face 402, only a minimal dead zone is formed on the face 402. As a result, the showerhead 400 produces a coherent and balanced spray pattern that provides a consistent coverage area and a pleasant showering experience for the user, regardless of the selected water delivery function. Furthermore, by interleaving the first curves 410 and the second curves 412, the third water delivery function, which uses both sets of nozzles 404 and 406 simultaneously, is operable to discharge water in a more coherent and balanced manner resulting in an improved showering experience.

Additionally, the number of nozzles in each of the first set of nozzles 404 and the second set of nozzles 406, as well as a corresponding total cross-sectional area (i.e., flow area) of openings in the first set of nozzles 404 and the second set of nozzles 406, are chosen to provide a pleasant sensation that contributes to the improved showering experience, regardless of the selected water delivery function.

In one exemplary embodiment, the first set of nozzles 404 has from 15 to 45 nozzles, inclusive, with a total cross-sectional area of the openings in the nozzles 404 being within 0.010 $in^2$ to 0.045 $in^2$, inclusive. In another exemplary embodiment, the first set of nozzles 404 has from 19 to 42 nozzles, inclusive, with a total cross-sectional area of the openings in the nozzles 404 being within 0.015 $in^2$ to 0.040 $in^2$, inclusive. In yet another exemplary embodiment, the first set of nozzles 404 has from 22 to 38 nozzles, inclusive, with a total cross-sectional area of the openings in the nozzles 404 being within 0.018 $in^2$ to 0.037 $in^2$, inclusive. In still another exemplary embodiment, the first set of nozzles 404 has from 24 to 36 nozzles, inclusive, with a total cross-sectional area of the openings in the nozzles 404 being within 0.019 $in^2$ to 0.041 $in^2$, inclusive.

In one exemplary embodiment, the first set of nozzles 404 has 24 nozzles with a total cross-sectional area of the openings in the nozzles 404 being approximately 0.022 $in^2$. In another exemplary embodiment, the first set of nozzles 404 has 24 nozzles with a total cross-sectional area of the openings in the nozzles 404 being approximately 0.033 $in^2$. In yet another exemplary embodiment, the first set of nozzles 404 has 36 nozzles with a total cross-sectional area of the openings in the nozzles 404 being approximately 0.025 $in^2$. In still another exemplary embodiment, the first set of nozzles 404 has 30 nozzles with a total cross-sectional area of the openings in the nozzles 404 being approximately 0.038 $in^2$.

In one exemplary embodiment, the second set of nozzles 406 has from 20 to 90 inclusive, with a total cross-sectional area within 0.012 $in^2$ to 0.060 $in^2$, inclusive. In yet another exemplary embodiment, the second set of nozzles 406 has from 25 to 65 nozzles, inclusive, with a total cross-sectional area within 0.018 $in^2$ to 0.053 $in^2$, inclusive. In still another exemplary embodiment, the second set of nozzles 406 has from 27 to 70 nozzles, inclusive, with a total cross-sectional area within 0.020 $in^2$ to 0.067 $in^2$, inclusive.

In one exemplary embodiment, the second set of nozzles 406 has 36 nozzles with a total cross-sectional area of approximately 0.033 $in^2$. In another exemplary embodiment, the second set of nozzles 406 has 64 nozzles with a total cross-sectional area of approximately 0.051 $in^2$. In yet another exemplary embodiment, the second set of nozzles 406 has 27 nozzles with a total cross-sectional area of approximately 0.031 $in^2$. In still another exemplary embodiment, the second set of nozzles 406 has 70 nozzles with a total cross-sectional area of approximately 0.067 $in^2$.

The nozzle characteristics described herein (e.g., diameter of opening and total cross-sectional area) are based on nozzles having substantially circular openings. It will be appreciated that the general inventive concept encompasses other nozzle types, including nozzles having non-circular openings. The equivalent nozzle characteristics of a nozzle having a non-circular opening can be readily determined.

The examples of interleaving described above in conjunction with FIGS. 4-7 apply to FIGS. 12-15 as well.

The above description of specific embodiments has been given by way of example. From the disclosure given, those skilled in the art will not only understand the general inventive concept and its attendant advantages, but will also find apparent various changes and modifications to the structures and methods disclosed. For example, although the above exemplary embodiments are directed to multi-function showerheads that discharge water, the general inventive concept encompasses any multi-function apparatus for discharging any fluid. Furthermore, from the above disclosure, it should be obvious that more than two sets of nozzles can be interleaved among one another. As another example, it should be obvious that each of the curves formed from the sets of nozzles can comprise multiple arcs. It is sought, therefore, to cover all such changes and modifications as fall within the spirit and scope of the general inventive concept, as defined by the appended claims and equivalents thereof.

What is claimed is:

1. A multi-function showerhead comprising a plurality of nozzles for discharging fluid according to one of a plurality of fluid delivery functions, wherein said plurality of nozzles includes a first set of nozzles disposed on a face of said showerhead and a second set of nozzles disposed on said face of said showerhead, wherein a first fluid delivery function corresponds to discharging said fluid through said first set of nozzles, wherein a second fluid delivery function corresponds to discharging said fluid through said second set of nozzles, wherein said first set of nozzles includes a plurality of first curves, each of said first curves formed from at least three adjacent nozzles in said first set of nozzles, wherein said second set of nozzles includes a plurality of second curves, each of said second curves formed from at least three adjacent nozzles in said second set of nozzles, and wherein said first curves and said second curves are interleaved.

2. The multi-function showerhead of claim 1, wherein said plurality of first curves are encompassed by a first zone on said face;

wherein said plurality of second curves are encompassed by a second zone on said face; and wherein said first zone and said second zone substantially overlap.

3. The multi-function showerhead of claim 1, wherein at least one nozzle in each of said plurality of first curves is located between two adjacent second curves on said face, and wherein at least one nozzle in each of said plurality of second curves is located between two adjacent first curves on said face.

4. The multi-function showerhead of claim 1, wherein at least half of the nozzles in each of said plurality of first curves is located between two adjacent second curves on said face, and wherein at least half of the nozzles in each of said plurality of second curves is located between two adjacent first curves on said face.

5. The multi-function showerhead of claim 1, wherein all of the nozzles in each of said plurality of first curves is located between two adjacent second curves on said face.

6. The multi-function showerhead of claim 1, wherein all of the nozzles in each of said plurality of second curves is located between two adjacent first curves on said face.

7. The multi-function showerhead of claim 1, wherein said first set of nozzles includes at least 9 nozzles, and wherein said second set of nozzles includes at least 9 nozzles.

8. The multi-function showerhead of claim 1, wherein a number of nozzles in said first set of nozzles is the same as a number of nozzles in said second set of nozzles.

9. The multi-function showerhead of claim 1, wherein all nozzles in said first set of nozzles have the same dimensions.

10. The multi-function showerhead of claim 1, wherein all nozzles in said second set of nozzles have the same dimensions.

11. The multi-function showerhead of claim 1, wherein each nozzle in said first set of nozzles has an opening with a diameter within 0.028 inches to 0.046 inches, inclusive.

12. The multi-function showerhead of claim 1, wherein each nozzle in said second set of nozzles has an opening with a diameter within 0.020 inches to 0.042 inches, inclusive.

13. The multi-function showerhead of claim 1, wherein said first set of nozzles has 15 to 45 nozzles, inclusive.

14. The multi-function showerhead of claim 13, wherein said first set of nozzles have openings with a total cross-sectional area within 0.010 $in^2$ to 0.045 $in^2$, inclusive.

15. The multi-function showerhead of claim 1, wherein said second set of nozzles has 20 to 90 nozzles, inclusive.

16. The multi-function showerhead of claim 15, wherein said second set of nozzles have openings with a total cross-sectional area within 0.010 $in^2$ to 0.080 $in^2$, inclusive.

17. A nozzle arrangement comprising a plurality of nozzles for discharging fluid according to one of a plurality of fluid delivery functions, wherein said plurality of nozzles includes a first set of nozzles and a second set of nozzles, wherein a first fluid delivery function corresponds to discharging said fluid through said first set of nozzles, wherein a second fluid delivery function corresponds to discharging said fluid through said second set of nozzles, wherein said first set of nozzles includes a plurality of first curves, each of said first curves formed from at least three adjacent nozzles in said first set of nozzles, wherein said second set of nozzles includes a plurality of second curves, each of said second curves formed from at least three adjacent nozzles in said second set of nozzles, and wherein said first curves and said second curves are interleaved.

18. The nozzle arrangement of claim 17, wherein said plurality of first curves are encompassed by a first zone;

wherein said plurality of second curves are encompassed by a second zone; and wherein said first zone and said second zone substantially overlap.

19. The nozzle arrangement of claim 17, wherein at least one nozzle in each of said plurality of first curves is located between two adjacent second curves, and wherein at least one nozzle in each of said plurality of second curves is located between two adjacent first curves.

20. The nozzle arrangement of claim 17, wherein at least half of the nozzles in each of said plurality of first curves is located between two adjacent second curves, and wherein at least half of the nozzles in each of said plurality of second curves is located between two adjacent first curves.

21. The nozzle arrangement of claim 17, wherein all of the nozzles in each of said plurality of first curves is located between two adjacent second curves on said surface.

22. The nozzle arrangement of claim 17, wherein all of the nozzles in each of said plurality of second curves is located between two adjacent first curves on said surface.

* * * * *